US008365907B1

(12) United States Patent
Mooney et al.

(10) Patent No.: US 8,365,907 B1
(45) Date of Patent: Feb. 5, 2013

(54) SURVIVAL PACKAGE PROVIDING WATER AND FIRE MAKING SUPPLIES

(75) Inventors: Robert Mooney, Boca Raton, FL (US); Dale C. Hedrick, Kittery, ME (US)

(73) Assignee: Erudite Inc., Boca Raton, FL (US)

( * ) Notice: Subject to any disclaimer, the term of this patent is extended or adjusted under 35 U.S.C. 154(b) by 0 days.

(21) Appl. No.: 13/279,117

(22) Filed: Oct. 21, 2011

Related U.S. Application Data

(63) Continuation-in-part of application No. 13/166,805, filed on Jun. 22, 2011.

(51) Int. Cl.
*B65D 77/00* (2006.01)

(52) U.S. Cl. ..... 206/217; 206/446; 206/803; 229/93

(58) Field of Classification Search ..... 206/216–233, 206/427–435, 446, 499, 521, 583–594, 803; 229/93; 244/138 R, 138 A
See application file for complete search history.

(56) References Cited

U.S. PATENT DOCUMENTS 1,856,062 A * 4/1932 Houghton ..... 206/568
1,975,428 A * 10/1934 Robert ..... 206/430
2,033,349 A * 3/1936 Miller ..... 206/446
2,047,790 A * 7/1936 Mascarenhas ..... 229/93
2,300,473 A * 11/1942 Van Winkle ..... 206/499
2,435,150 A * 1/1948 Monks ..... 244/138 A
2,458,737 A * 1/1949 Salkowitz ..... 206/446
2,757,790 A * 8/1956 Gattuso ..... 206/446
3,342,439 A 9/1967 Behrendt
3,414,365 A * 12/1968 Cranston ..... 206/803
7,311,201 B2 * 12/2007 Lo ..... 206/446

* cited by examiner

*Primary Examiner* — Bryon Gehman
(74) *Attorney, Agent, or Firm* — Boris G. Tankhilevich

(57) ABSTRACT

A survival package provides fire making materials and water. The package includes a tube and at least one water bottle and fire starter assembly contained within the tube. The tube is made of combustible material, and may be a rolled paper or cardboard tube having first and second end caps and a plurality of tube sections. The tube may have a plurality of ventilation apertures. The water bottle and fire starter assembly includes a closed water bottle and a fire starter. The fire starter may be of wax and removably attached to the water bottle, or may be a paraffin toroid fitting over the water bottle cap, and may include a paper cup. The fire starter and the combustible tube can be used for fire making. The water bottle provides water for drinking or cooking. The survival package is usable in an airdrop package or as a standalone.

6 Claims, 13 Drawing Sheets

SURVIVAL PACKAGE PROVIDING WATER AND FIRE MAKING SUPPLIES

CROSS-REFERENCE TO RELATED APPLICATION

This application is a continuation-in-part of U.S. patent application Ser. No. 13/166,805, filed Jun. 22, 2011.

TECHNICAL FIELD

The technical field of the invention relates generally to special receptacles or packages and more specifically to packages including survival supplies.

BACKGROUND

During disasters of natural or man-made origins, or wartime, emergency supplies are often dropped by parachute from an airplane in an airdrop delivery. Emergency supplies can include water, food, cooking materials, shelter or tools.

U.S. Pat. No. 3,342,439 discloses an aerial drop assembly for emergency supplies. Emergency supplies are lowered to the ground from an aircraft by an aerial drop, in a drop assembly. A protective container made of double-faced corrugated stock (i.e. cardboard) is attached to a parachute. A cushion may be inserted in the base of the container for additional cushioning. The cushion may be a pad reinforced with sheets of paper, sheet plastic or corrugated paper bonded to opposed faces of the pad.

Delivery of water for drinking or cooking poses particular difficulties in airdrops. Water delivered in large containers typically cannot be hand carried out by soldiers or relief workers, as water is heavy. Bottled water is often lost as a result of bursting of plastic water bottles upon ground impact from the airdrop.

There is thus a need for an improved airdrop delivery system for delivering water to soldiers, relief or other emergency workers or survivors in an emergency. It is a goal of the present invention to provide a survival package that can be used as a standalone package or in an airdrop delivery system.

SUMMARY

Water for drinking or cooking, fuel for fire making, and a fire starter are provided in a survival package. The survival package can be used singly as a standalone package, or multiples of the survival packages can be dropped by parachute from an airplane in an airdrop package.

In one embodiment, the survival package includes a tube made of combustible material and at least one water bottle and fire starter assembly contained within the tube. The water bottle and fire starter assembly includes a water bottle and a fire starter. The water bottle is closed. The fire starter is of a shape providing a complementary fit to the water bottle. The tube and the fire starter provide fire making materials. The fire starter is usable to light the tube on fire.

In one embodiment, the survival package includes a paper or cardboard tube and one or more water bottle and fire starter assemblies. The paper or cardboard tube has first and second end caps. The paper or cardboard tube has a plurality of tube sections. Each of the one or more water bottle and fire starter assemblies is contained within a respective one of the tube sections. Each of the one or more water bottle and fire starter assemblies includes a closed water bottle and a wax fire starter. The wax fire starter is removably attached to the closed water bottle. The wax fire starter and the paper or cardboard tube can be used for fire making.

In one embodiment, the survival package includes a rolled paper tube and one or more water bottle and fire starter assemblies contained within the tube. The rolled paper tube has a plurality of ventilation apertures. Each of the one or more water bottle and fire starter assemblies includes a water bottle, a paraffin toroid and a paper cup. The water bottle has a water bottle cap. The paraffin toroid is dimensioned to fit over the water bottle cap. The paper cup is dimensioned to snugly fit over the paraffin toroid. A fire can be started by placing the paraffin toroid, in the paper cup, within the rolled paper tube and lighting the paper cup.

DETAILED DESCRIPTION

Figure 1:
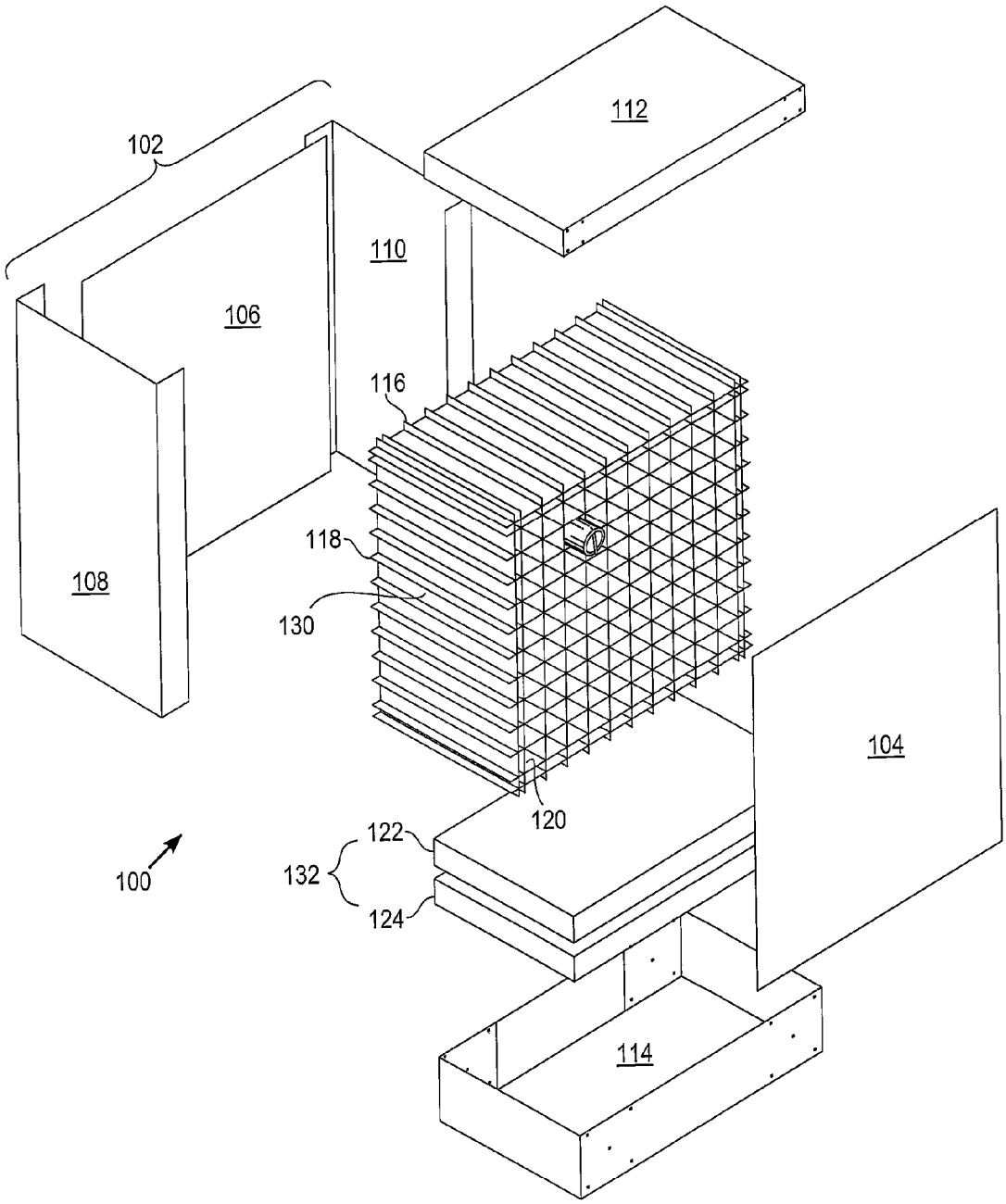
FIG. 1 is a perspective exploded view of an airdrop delivery system for water and fire making supplies.

With reference to FIG. 1, the airdrop delivery system 100 provides a system for getting water and combustible materials with which to build a fire to soldiers in a war zone, to disaster relief workers or to survivors in an emergency situation. The airdrop delivery system 100 for water and fire making materials and variations and various subassemblies thereof have improvements over known airdrop containers and airdrop delivery systems as will be described.

Typically, a first package or set of packages in an airdrop delivers water, and a separate second package or set of packages in the airdrop or a subsequent airdrop delivers bundles of firewood, synthetic fire logs or other fire making materials. The airdrop delivery system 100 combines delivery of water and fire making materials in a single package or set of similar packages, and increases the recovery rate of intact water bottles as compared to previously available airdrop delivery methods or packages. Subassemblies of the airdrop delivery system 100 absorb impact as the package hits the ground at the end of the parachute-controlled descent, thus decreasing the tendency of plastic water bottles to burst upon ground impact of the package. Further, the packaging subassemblies provide fire making materials.

In the version shown in FIG. 1, the airdrop delivery system 100 has an outside box 102 made of corrugated cardboard with front wall 104, rear wall 106, side walls 108 and 110, a top cap 112 and a bottom cap 114. Variations of the airdrop delivery system 100 have no outside box or an outside box of differing shapes or made of other materials e.g. waxed cardboard, wood or wood products, or composite, and/or are banded or covered in plastic shrinkwrap.

A load matrix core 130 with an array of horizontally oriented compartments 120 sits atop an energy absorbing base 132. The energy absorbing base 132 has in one embodiment an upper energy absorbing base 122 and a lower energy absorbing base 124, each of which is made of multiple sheets of corrugated cardboard, accordion-folded corrugated cardboard, molded and dried wood pulp or paper pulp, other wood products, or other energy absorbing material.

The load matrix core 130 is a matrix of semi-rigid collapsible material defining honeycomb-like interstices. In the example shown in FIG. 1, horizontally oriented corrugated cardboard sheets 118 and vertically oriented corrugated cardboard sheets 116 are matrix walls defining an orthogonal array of the horizontally oriented compartments 120. Variations can have a lattice with vertically, horizontally and/or diagonally oriented matrix walls, vertical arrays, horizontal arrays, hexagonal arrays, triangular arrays, diagonally oriented arrays and arrays of other geometric arrangements of the compartments 120. Arrays can have orthogonal walls or walls at other angles with respect to each other, and compartments with regular spacing in one direction e.g. horizontally, vertically or diagonally, regular spacing in two directions e.g. horizontally and vertically, orthogonal diagonal directions, or non-orthogonal diagonal directions, regular spacing in three directions e.g. an hexagonal or triangular array, irregular spacings, regular spacings in one direction and irregular spacings in another direction and so on. Variations can be made of other materials as discussed above with regard to the outside box 102 and/or as discussed above with regard to the energy absorbing base 124.

Figure 2:
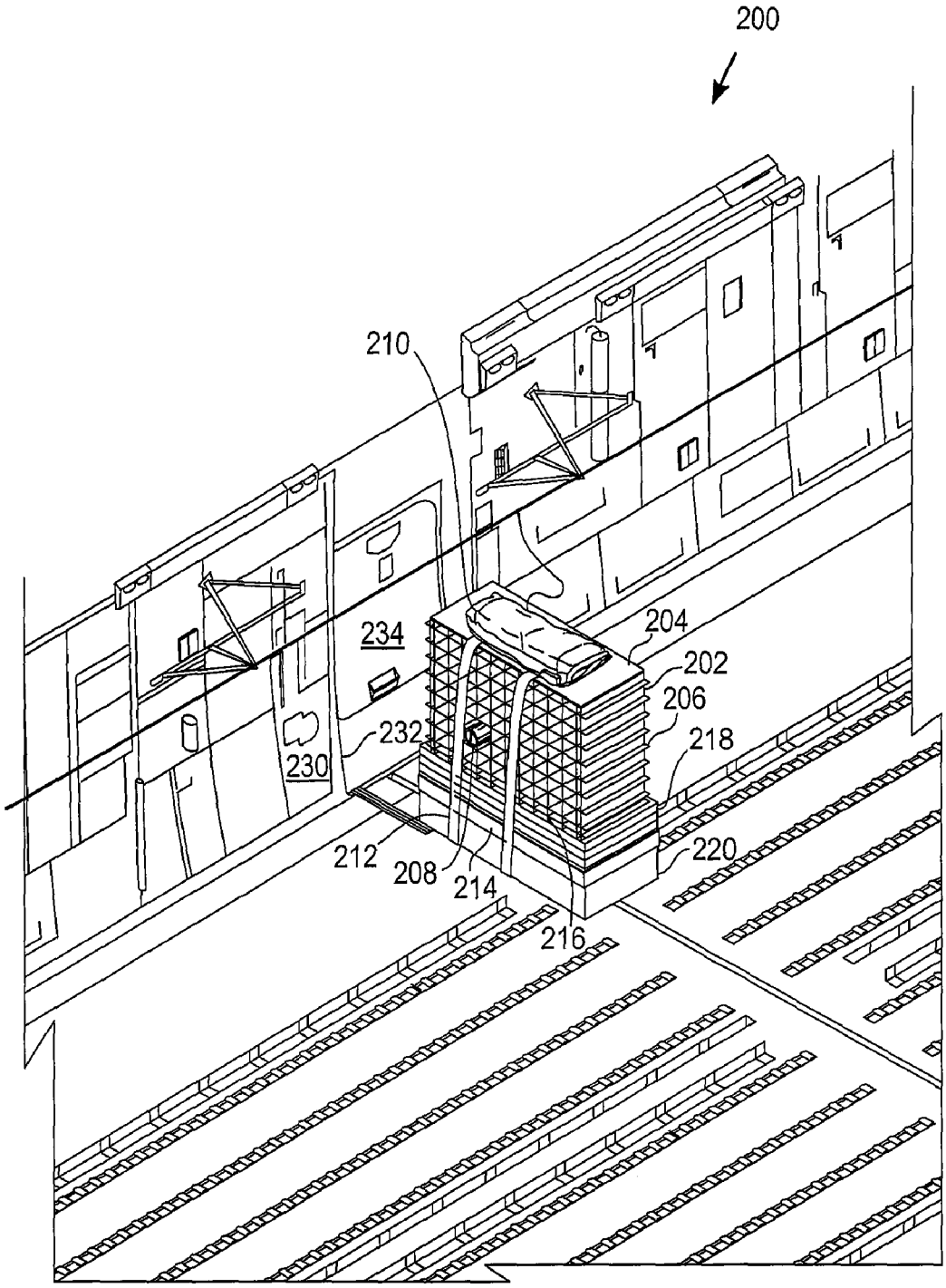
FIG. 2 is a perspective view of a drop unit, including a packed parachute and an assembled airdrop delivery system that is a variation of the airdrop delivery system of FIG. 1. The drop unit is shown exiting through the jump door of an airplane.

With reference to FIG. 2, a drop unit 200 that includes a variation of the airdrop delivery system 100 is exiting through the jump door 232 of an airplane 230. The jump hatch 234 is shown partially open, and is about to be opened further so that the drop unit 200 can proceed unimpeded.

In the drop unit 200, a load matrix core 202 with orthogonally intersecting diagonally oriented matrix walls 204 and 206 sits atop an energy absorbing base 218. A bottom cap 220 contains the lower portions of the drop unit 200. Vertical banding 212 and horizontal banding 214 retain the subassemblies of the drop unit 200. A packed parachute 210 is attached at the top of the drop unit 200. Inserted into compartments defined by the matrix walls 204, 206 of the load matrix core 202 are cylindrical articles 208 for delivery. The cylindrical articles 208 herein depicted are hollow cylinders or canisters made of wood or wood product containing plastic water bottles, about which more will be described with reference to FIGS. 5-8.

Figure 3:
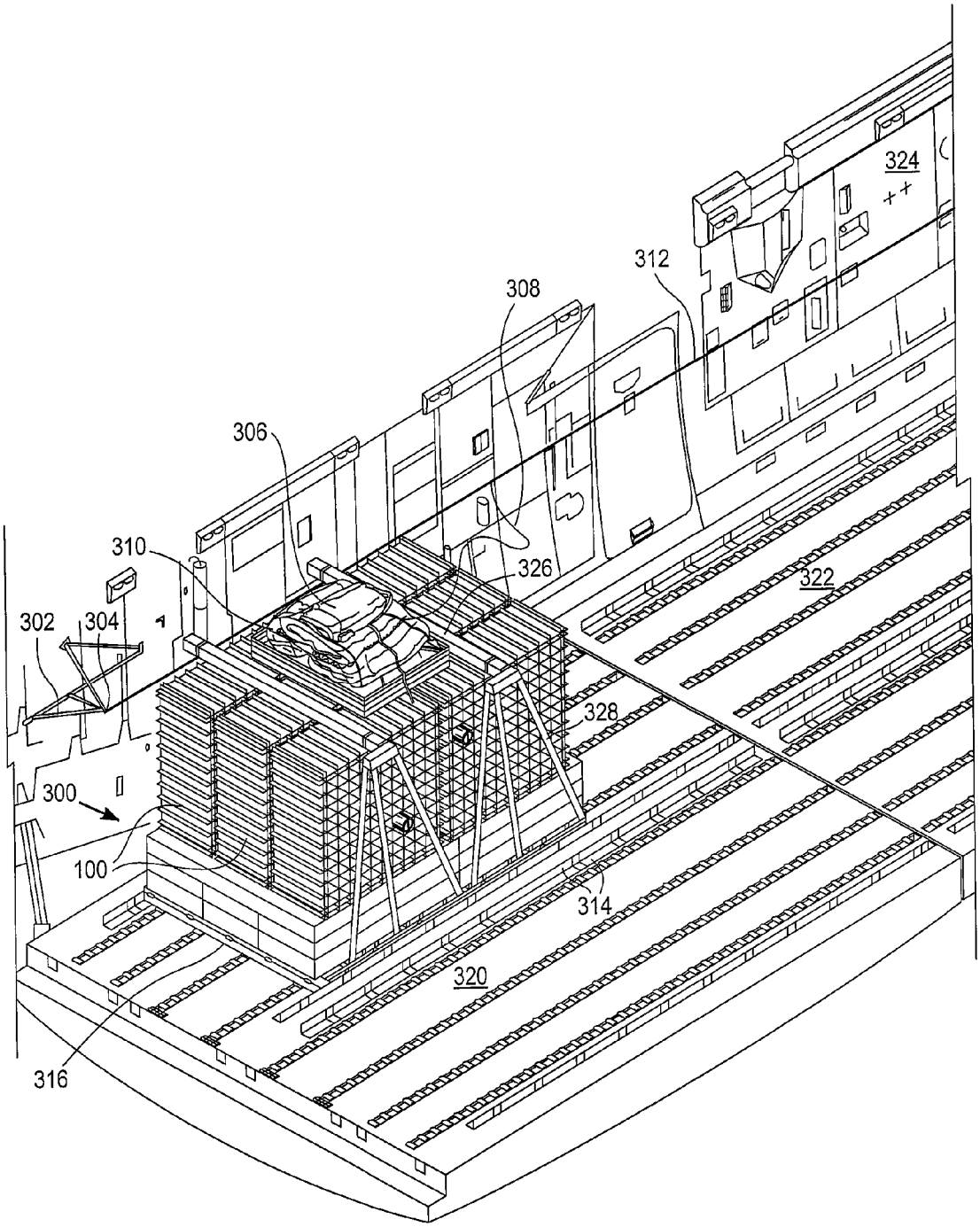
FIG. 3 is a perspective view of a drop pallet, including a parachute system and a plurality of airdrop delivery systems such as shown in FIGS. 1 and 2. The drop pallet is shown exiting the airdrop platform of a military transport.

With reference to FIG. 3, multiples of the airdrop delivery system 100 can be bundled together and assembled onto a drop pallet 300 for delivery of larger amounts of water and fire making materials using a larger airplane, such as a C-17 military transport. The drop pallet 300 has a wood pallet for a base. The drop pallet 300 is shown exiting the airdrop platform 316 of an airplane 322 so-equipped. The airplane 322 is further equipped with a short aft anchor cable support 302, and anchor cable stop 304 and an anchor cable 312. A deployment parachute 306 atop the drop pallet 300 has a release-away static-line 308 clipped to the anchor cable 312. One or more strapping bars 326 and one or more straps 328 secure the multiples of the airdrop delivery system 100 on the drop pallet 300. When the drop pallet 300 clears the airdrop platform 316 and begins freefall, the static-line 308 initiates the opening of the deployment parachute 306. The drop pallet 300 then descends to the ground, slowed by the parachute.

Figure 4:
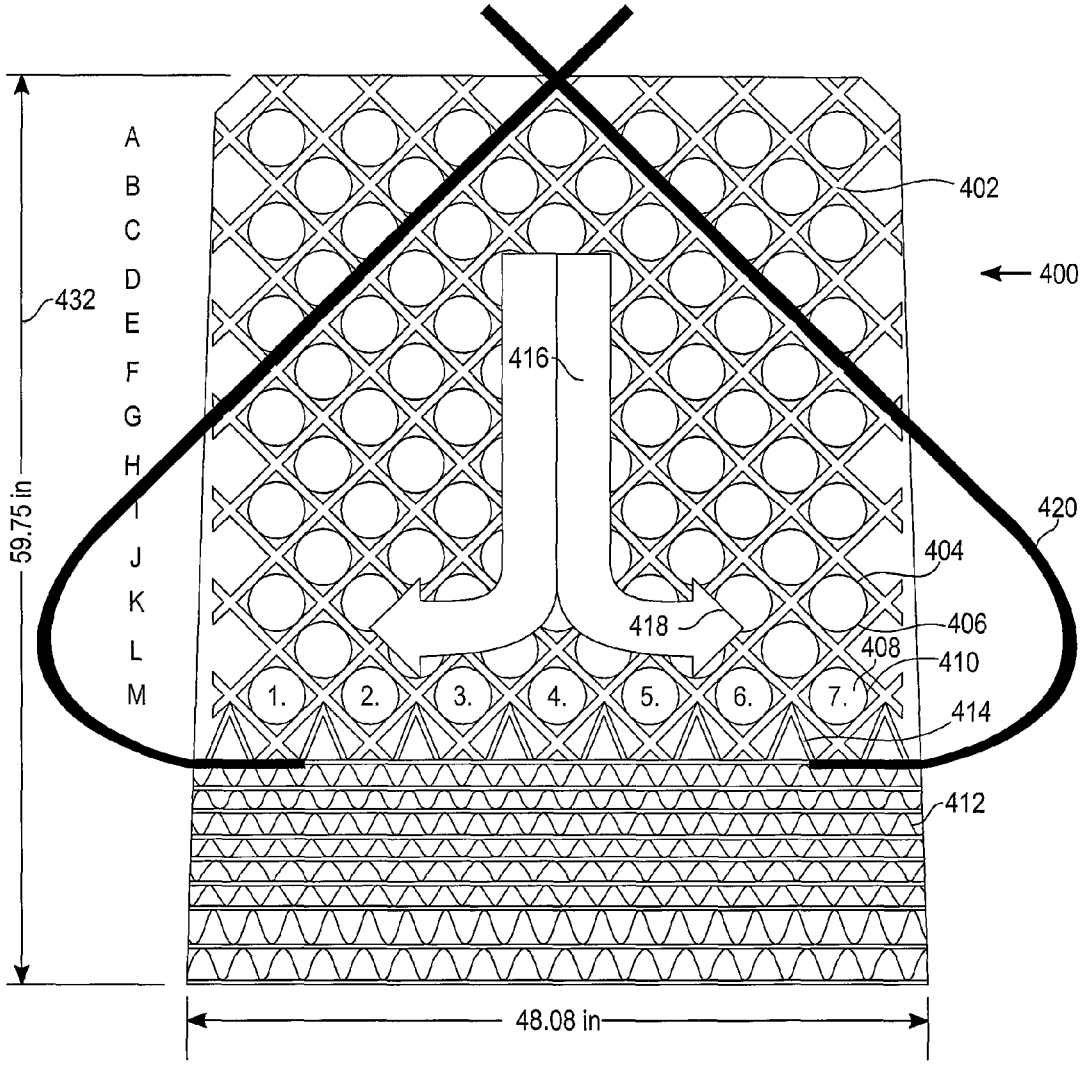
FIG. 4 is an elevated front view of the airdrop delivery system of FIG. 2, showing effects of impact.

With reference to FIG. 4, effects of a ground impact on an airdrop delivery system 400 are shown, as are aspects of structure working to dissipate impact energy. Prior to impact, the load matrix 402 is intact and undistorted as shown, and has cylindrical articles 408 such as canisters containing water or water bottles stowed in compartments 410 formed by the intersecting matrix walls 404 and 406. The energy absorbing base 412 is likewise intact and undistorted. Banding 420, shown distorted after impact, is initially undistorted and surrounds the perimeter of the load matrix or surrounds the perimeter of the load matrix 402 and the energy absorbing base 412. Upon impact of the airdrop delivery system 400 with the ground e.g. as the drop unit 200 or the drop pallet 300 completes the descent, the energy absorbing base 412 compresses. Depending on severity of impact, the load matrix 402 may arrive relatively intact.

However, the load matrix 402 has features designed to absorb impact energy so that fewer of the plastic water bottles burst in a less gentle landing of the airdrop delivery system 400. The matrix walls 404 and 406 of the load matrix 402, which may be made of cardboard, waxed cardboard or corrugated cardboard etc., are perforated to tear and absorb energy on impact.

Water and fuel storage cylinders or canisters, or other cylindrical articles 408, are loaded horizontally to better enable the package to absorb impact energy with dissipation over a larger surface area as compared to vertically loaded water containers or other cylindrical articles 408. Further, the cylindrical articles 408 can roll if released from the load matrix 402 upon impact. Vertically loaded cylindrical articles would be less likely to dissipate impact energy and more likely to break or otherwise be damaged than horizontally loaded cylindrical articles.

Reinforcement wedges 414 provide support and alignment at the bottom portion of the load matrix 402, and have an additional function. The reinforcement wedges 414 provide an impact focus at a joining location for the matrix walls 404 and 406, and promote splitting and tearing of the load matrix 402 to absorb and dissipate impact energy. Perforations as discussed above may be placed at such locations and elsewhere in the load matrix. The number and locations of the perforations can be varied according to material strength, desired control of splitting and tearing, mass of the cylindrical articles 408 and other factors.

Upon a ground impact sufficient to tear portions of the load matrix 402, the cylindrical articles 408 will move in a downward direction 416 and an outward direction 418, and will either disburse out of the airdrop delivery system 400 or be retained by the banding 420. The banding 420 can bow outward as shown in FIG. 4 to retain some or all of the cylindrical articles 408.

Figure 5:
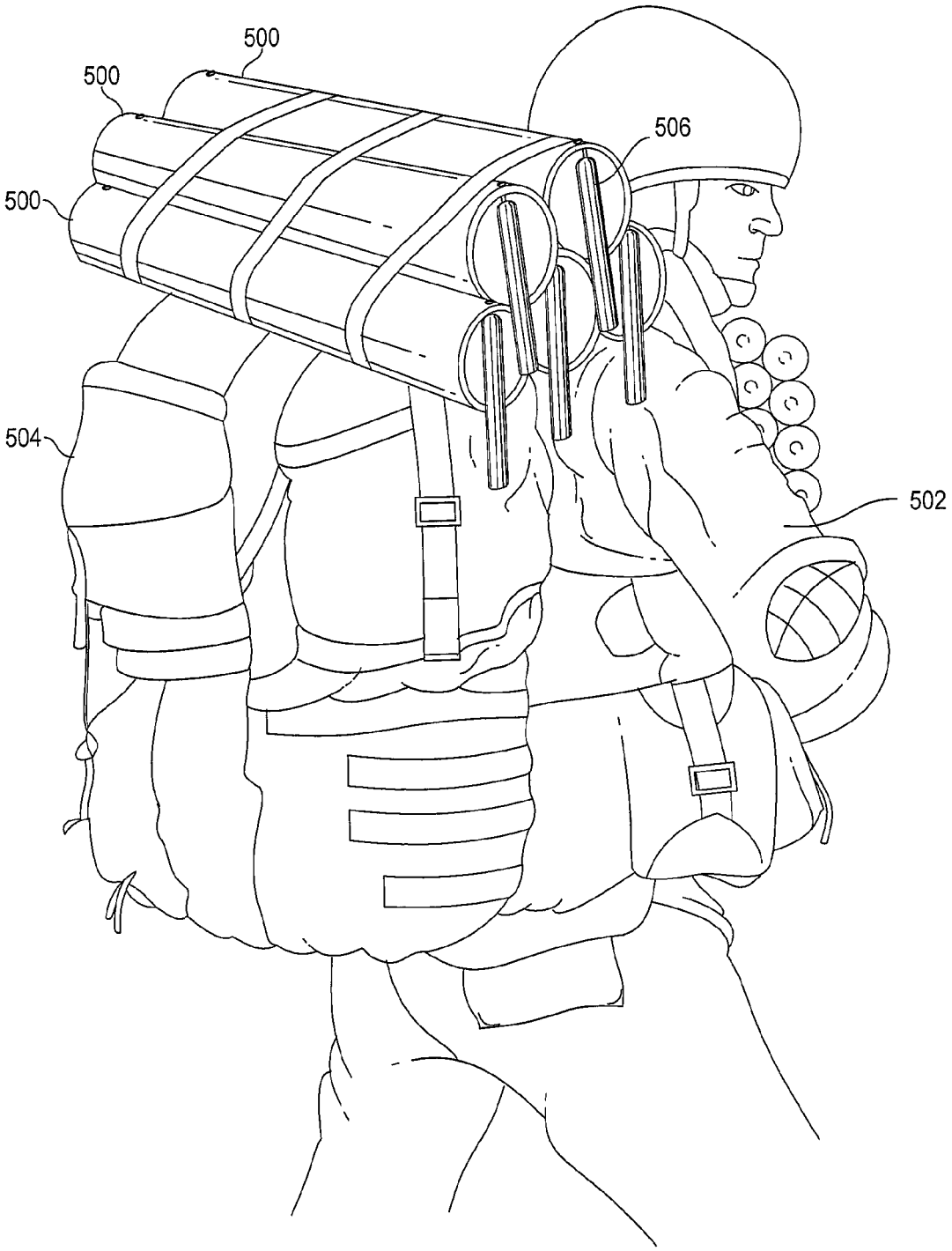
FIG. 5 is a perspective view of a soldier carrying canisters holding water bottles, the canisters having been delivered by and recovered from the airdrop delivery system of FIG. 1, 2 or 3.

With reference to FIG. 5, a soldier 502 is shown carrying several canisters 500 that have been recovered from the airdrop delivery system 400 or variation thereof. Each canister 500 is one of the cylindrical articles 408 carried in the airdrop delivery system 400. The canisters 500 are strapped to the frame or other portion of the rucksack 504 the soldier 502 carries. A canister 500 can also be carried by grasping the closure device 506 which then functions as a handle. A canister overall length of 25½ inches allows passage through standard doorways. Other dimensions may be devised, such as a maximum length of thirty inches.

Figure 6:
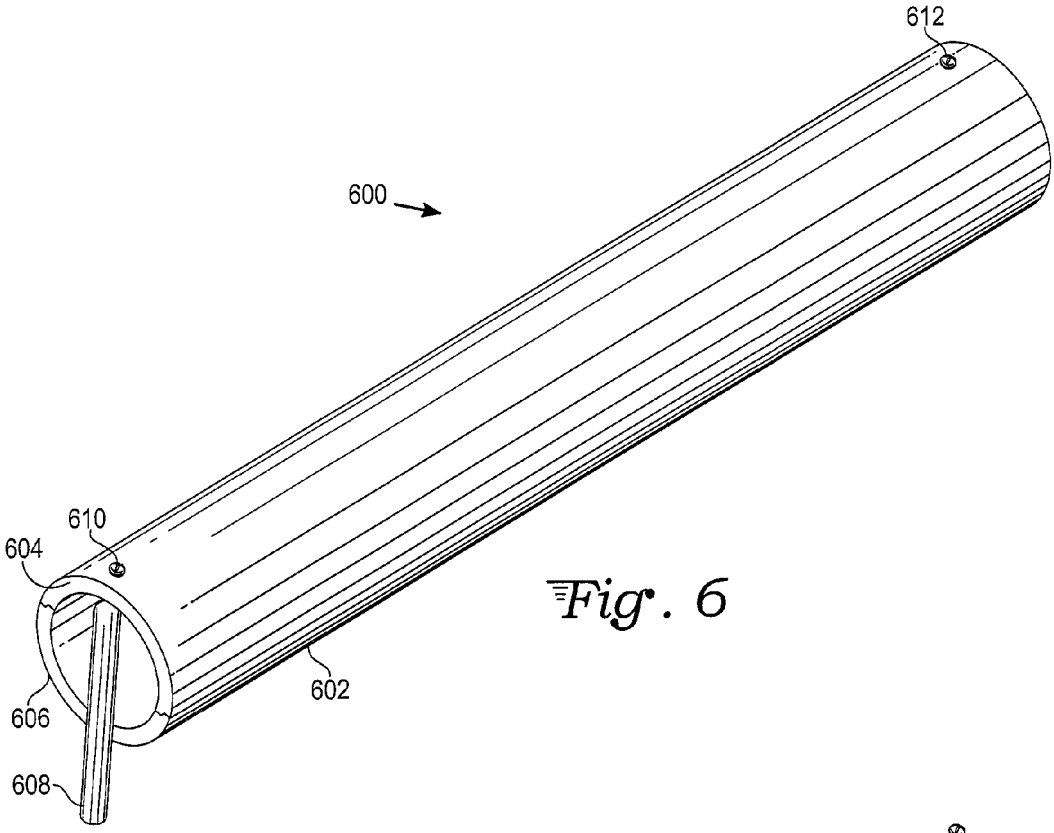
FIG. 6 is a perspective view of one of the canisters of FIG. 5.
Figure 7:
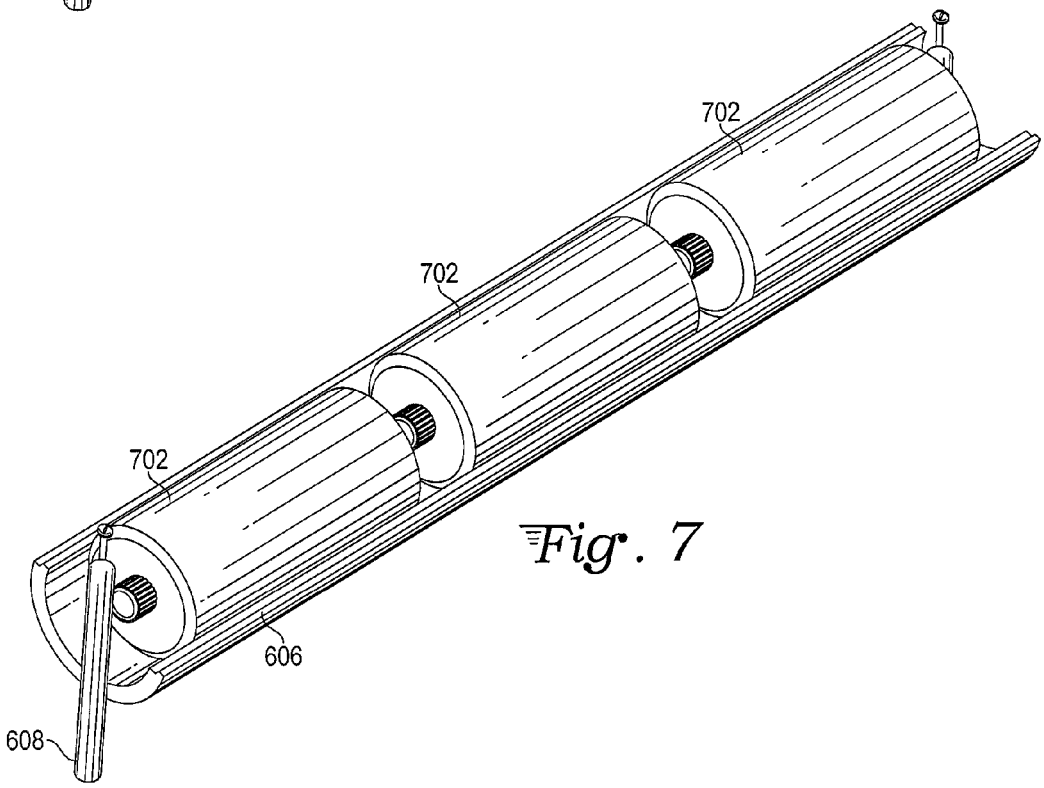
FIG. 7 is a perspective view of the canister of FIG. 6 with the top half removed and showing water bottles inside the canister.

With reference to FIG. 6, a canister 600 such as carried in the airdrop delivery system 400 is a synthetic wood fuel log tube 602 made of combustible fire log material and holding water bottles inside (not visible in FIG. 6, and see FIG. 7). Each canister 600 is a package of drinking or cooking water and fire making fuel. The tube 602 has two opposed half-pipe sections 604 and 606 that are essentially identical. Having essentially identical half-pipe sections allows manufacture from a single mold. The essentially identical opposed half-pipe sections 604 and 606 may differ in fastener fittings such as apertures, notches or fastener mating hardware, or have differences resulting from manufacturing processes and tolerances or other minor considerations.

Materials suitable for the combustible fire log material include cellulose fibers, pressed particles in a combustible binder, mixtures of resins and wax, compressed sawdust, compressed wood chips, wood pulp, paper, cardboard, corrugated cardboard and other wood products. Where drinking water is an intended use, the fire log material must house a compatible container, such as a plastic bottle or bag.

A closure device 608 keeps the water bottles inside the tube 602, thus closing the respective end of the tube 602. The closure device 608 further holds the upper half-pipe section 604 and lower half-pipe section 606 together. In variations, both ends of the tube 602 have a respective closure device 608, or one end of the tube 602 has a closure device 608 and the other end of the tube 602 is closed off, or a bolt, screw or other fastener 610, 612 secures the closure device 608 to the tube 602. As discussed above, the closure device 608 can act as a handle. In further variations, the canister 600 has a closure device and a separate handle, a fastener and a separate handle, an extraction device for removing the canister from a compartment in the airdrop delivery system, or various combinations thereof. In still further variations, the canister has a unitary tube, complementary sections, unevenly divided sections, or more than two sections. In still further variations, a pressed log that is divided down the middle. In still further variations, one will use a heavy wall corrugated paper tube.

With reference to FIG. 7, removal of one of the half-pipe sections of the canister 600 reveals the water bottles 702 held inside the tube 602. Upon removal of the closure device 608, one or more of the water bottles 702 can be removed from the tube 602 by sliding the water bottle 702 out the end of the tube 602 or by separating the two halves of the tube 602 and lifting the water bottle 702 out of the remaining half-pipe section 606 of the tube 602. Variations of the canister 600 and variations of the water bottle 702 have the canister 600 containing various numbers of water bottles e.g. 1-10 water bottles, water in other types of containers such as water bags, bladders or cans, or water mixed with vitamins, flavors or nutrients. Still further variations of the canister 600 deliver water and food, e.g. water in some of the bottles and food in others of the bottles or other containers.

Figure 8:
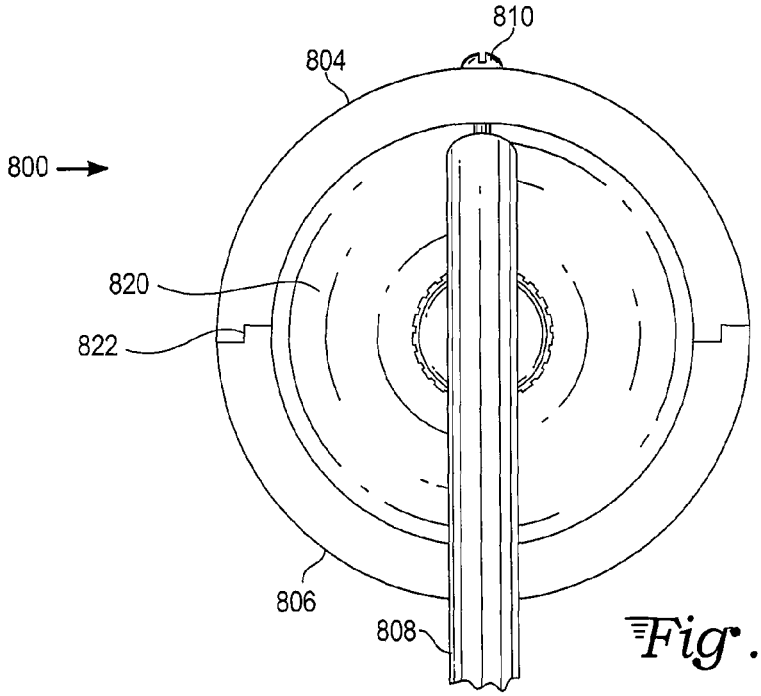
FIG. 8 is an elevated end view of the canister of FIG. 6.

With reference to FIG. 8, further details of the canister 800 are shown. The upper half-pipe section 804 and lower half-pipe section 806 have mating alignment surfaces 822 that fit the two halves of the tube together. Further variations with or without mating alignment surfaces and variations of the mating alignment surfaces may be devised. The water bottle 820 fits snugly inside of the tube formed by the half-pipe sections 804 and 806. The wood or wood product of which the two half-pipe sections 804 806 are made provides high heat output when a fire is built using one or more such sections, and provides thermal insulation in cold weather to reduce, delay or prevent freezing of the water in the water bottles while in the canister 800.

Figure 9:
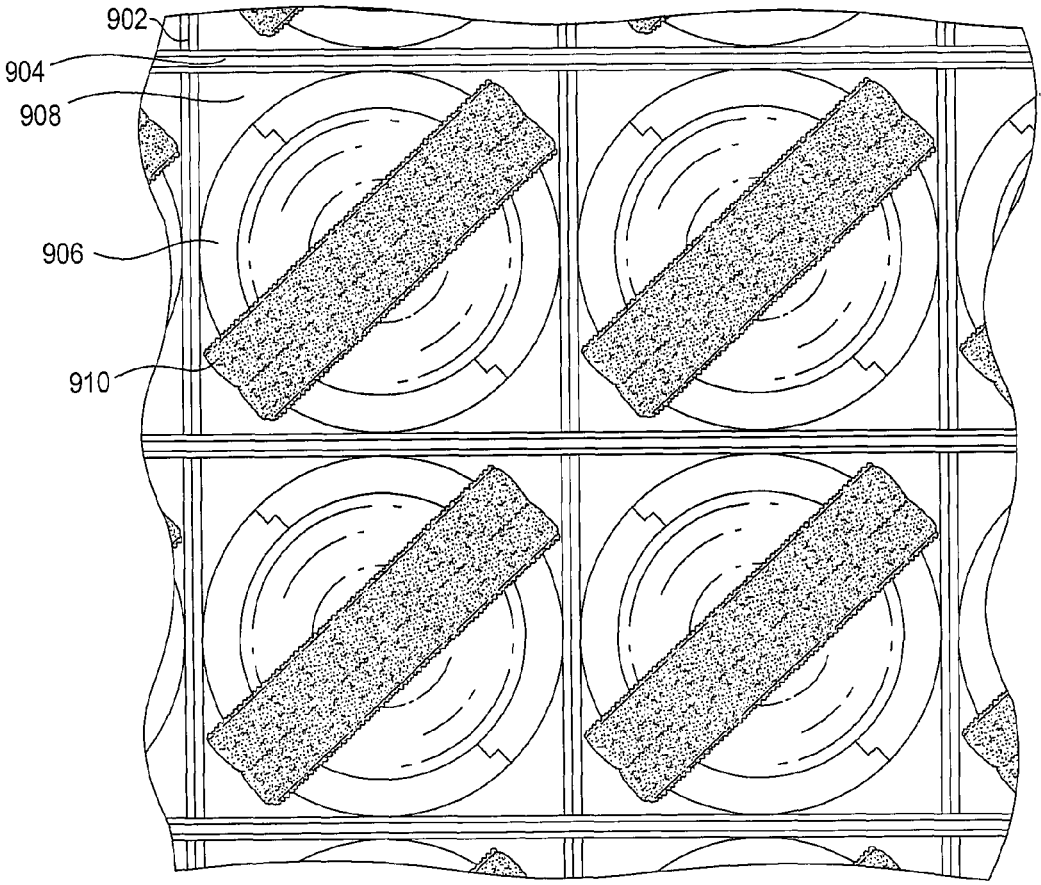
FIG. 9 is a perspective end view of canisters such as the canister of FIG. 5 or 6 loaded in the airdrop delivery system of FIG. 1, the canisters having an alternative closure device.

With reference to FIG. 9, a close-up view of the airdrop delivery system shows details in construction and materials of the matrix walls 902 and 904, and a variation in the canister 906. Multi-layered corrugated cardboard is used in making the matrix walls 902 and 904, which are deeply notched e.g. to one half of the depth of the compartment 908. A cotton lanyard 910 can be pulled in order to extract the canister 906 from the compartment 908 defined by the matrix walls 902 and 904. The cotton lanyard 910 can also be used as a fire wick, to start a fire using one or more of the wood fuel log tubes or the halves thereof.

Figure 11:
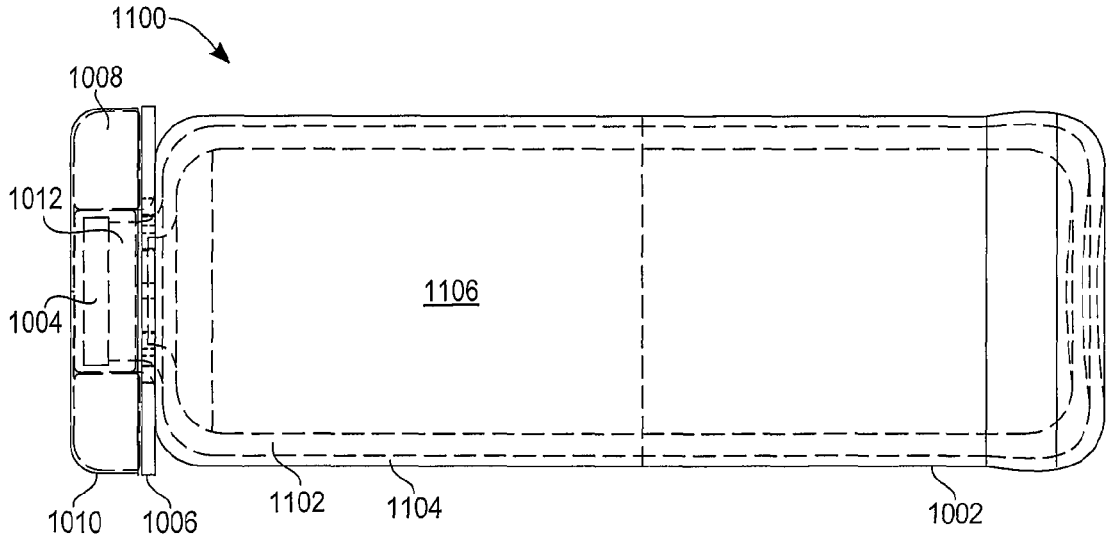
FIG. 11 is a side view of the assembled water bottle and fire starter assembly of FIG. 10.
Figure 12:
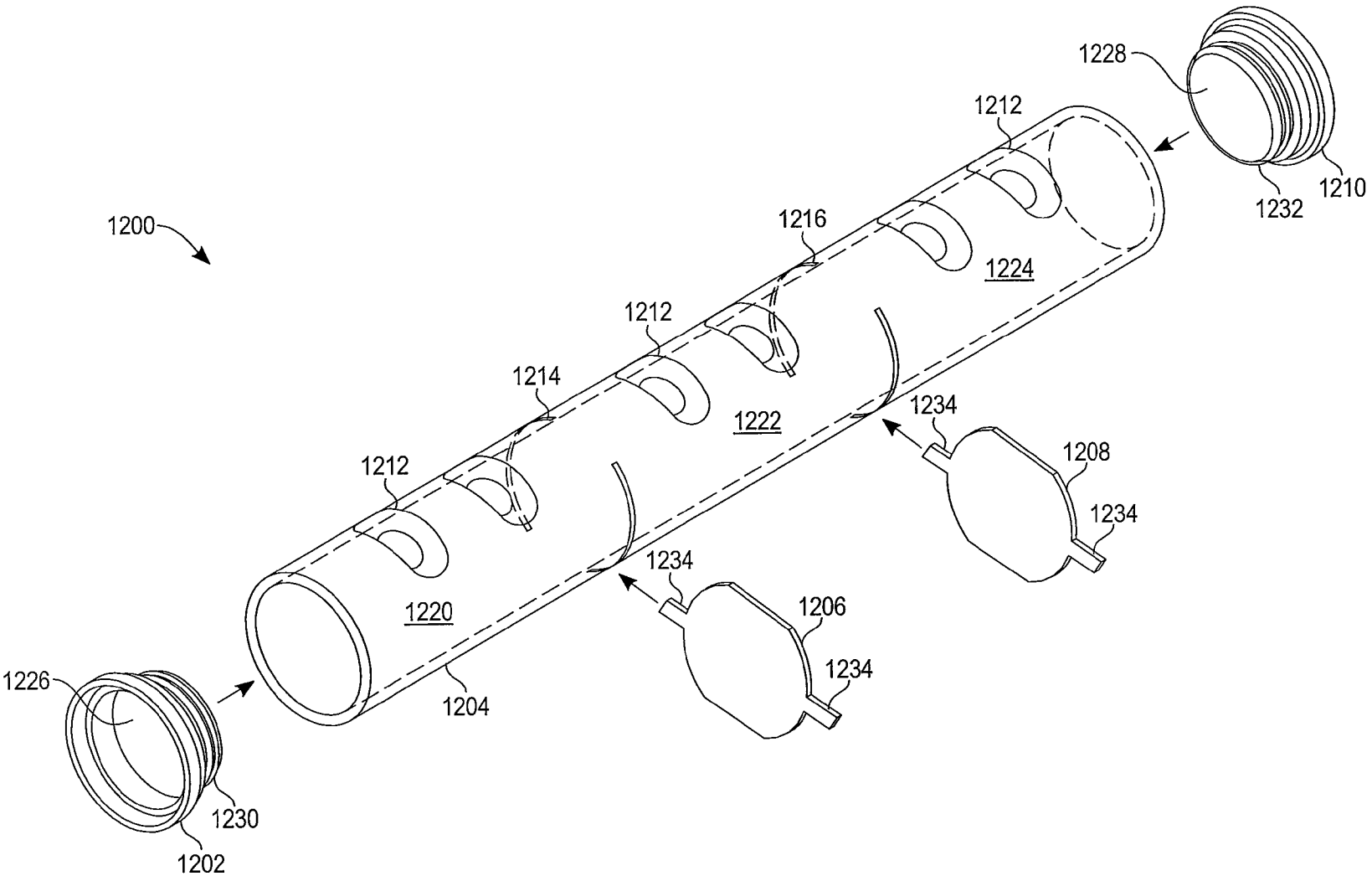
FIG. 12 is a perspective exploded view of a canister as a further embodiment of the canisters of FIGS. 5-9.
Figure 13:
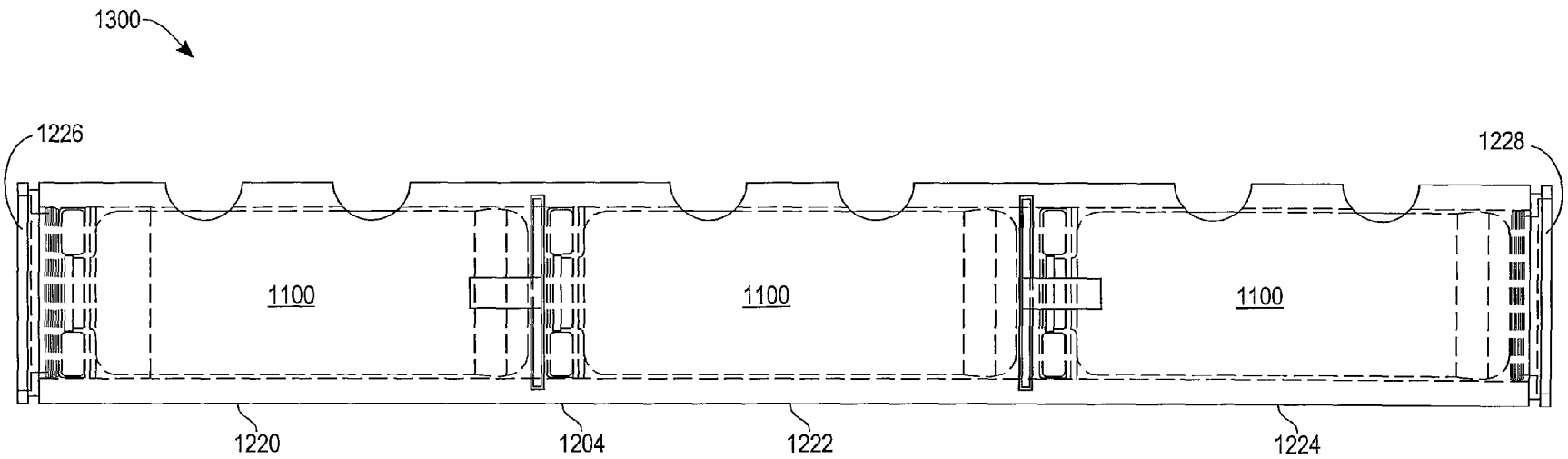
FIG. 13 is a side view of an assembled canister of FIG. 12, containing three of the water bottle and fire starter assemblies of FIGS. 10 and 11, in accordance with the present invention.

With reference to FIGS. 10-13, further embodiments of a canister, a water bottle and a fire starter are shown individually and as a survival package suitable for standalone use or use in the airdrop delivery system. The components can be used together as shown in FIG. 13, or can be swapped for related components in other embodiments in a modular fashion.

Figure 10:
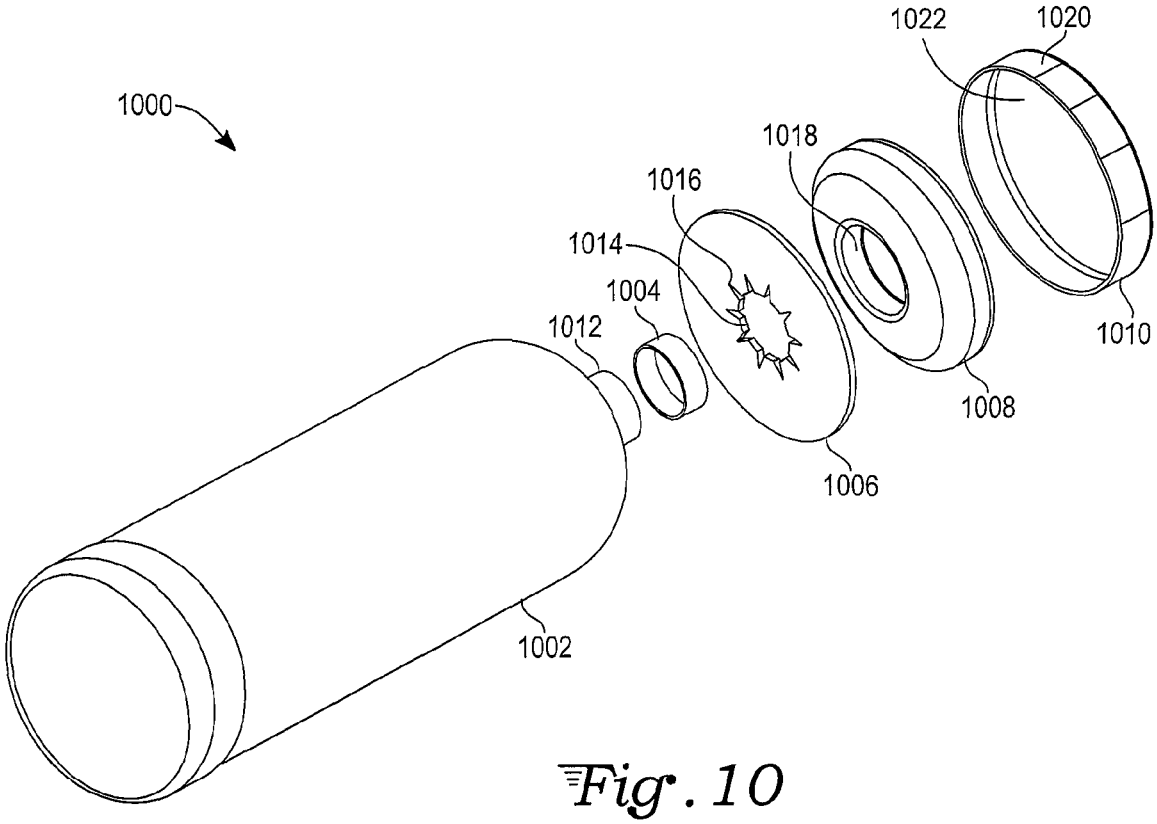
FIG. 10 is a perspective exploded view of a water bottle and fire starter assembly suitable for carrying in a canister such as the canisters shown in FIGS. 5-9 and 12-13.

In FIG. 10, the components of the water bottle and fire starter assembly 1000 are shown. A water bottle 1002 with a water bottle cap 1004 holds a nominal half liter of water and is dimensioned to fit within a canister. A collar ring 1006, made of cardboard, fits over the bottle neck 1012 of the water bottle 1002, and helps hold the water bottle 1002 in-place in the canister. A central aperture 1014 and expansion slits 1016 are cut into the collar ring 1006, and dimensioned for a snug fit over the bottle neck 1012. The expansion slits 1016 allow the collar ring 1006 to be slipped onto or off of the water bottle 1002 while the water bottle cap 1004 remains in place. The collar ring 1006 may also be assembled onto the water bottle 1002 prior to the assembly of the water bottle cap 1004 to the water bottle 1002.

A fire starter 1008 has a central aperture 1018, which fits over the water bottle cap and thus fits over the neck of the water bottle. In the embodiment shown, the fire starter 1008 is a doughnut-shaped ring, i.e. a toroid, and is a paraffin wax-based product. A paper cup 1010 fits snugly over the fire starter 1008. The paper cup has a base 1022 and a circumferential wall 1020. Usage of the fire starter 1008 will be discussed in a method for starting a fire, following the introduction of the assembled canister embodiment of FIG. 13 and a method of assembly.

In the embodiment shown in FIG. 10, the water bottle 1002 includes an inner plastic water bottle and an outer insulative shell e.g. made of foam rubber, styrofoam, or other thermally insulative and/or impact shock dissipative material. In further embodiments, the water bottle 1002 includes an outer plastic water bottle and an inner collapsible bladder, or the water bottle 1002 includes an outer shell and an inner vacuum bottle, i.e. the bottle 1002 is or includes a double-walled vacuum bottle. In one embodiment, the water bottle 1002 is a single-walled bottle made of a known plastic material. In still further embodiments, the water bottle 1002 has the water bottle cap 1004 integrated with the water bottle 1002. The water bottle cap 1004 is generally a sealing or closure device for the water bottle 1002, and can be a flip top cap, a screw-on screw-off cap, a nozzle that slides up to open and slides down to close, or other type of known device for sealing, closing and opening a water bottle, and can be single-use or reusable.

In FIG. 11, the assembled water bottle and fire starter assembly 1100 is shown. The water bottle 1002 contains water in an interior volume 1106 of the bottle, and is sealed by the water bottle cap 1004. The collar ring 1006, fire starter 1008 and paper cup 1010 are removably assembled or attached to the water bottle neck 1012 and water bottle cap 1004. In the embodiment shown, the water bottle 1002 includes an inner plastic water bottle 1102 (surfaces depicted in ghost lines) and an outer insulative shell 1104 (inner surface depicted in ghost lines, outer surface depicted in solid line). The water bottle and fire starter assembly 1100 is ready for insertion into a canister for transport, or the assembly is ready for disassembly and use for starting a fire and providing drinking water.

In FIG. 12, the components of the canister 1200 are shown. The canister 1200 includes a rolled paper sleeve 1204 that is dimensioned to contain three units of the water bottle and fire starter assembly 1100. A rolled paper sleeve 1204 is, in this embodiment, a tube made of rolled paper or cardboard and about 25.5 inches long. The rolled paper sleeve 1204 has section cuts 1214, 1216 which leave bridging material in place and allow a user with a knife to sever the tube into three approximately equal length tube sections 1220, 1222, 1224, each tube section being about 8.5 inches long. Paper or cardboard partitions 1206, 1208 are inserted through the respective section cuts 1214, 1216 of the rolled paper sleeve 1204 to create compartments, and tabs 1234 are folded and secured to the rolled paper sleeve 1204, for example by application of tape or glue. Each tube section or compartment can hold a respective water bottle and fire starter assembly 1100. Apertures 1212 in the rolled paper sleeve 1204 provide ventilation when the rolled paper sleeve 1204 is used as a fire making material. In the embodiment shown, each section 1220, 1222, and 1224 of the rolled paper sleeve 1204 has two ventilation apertures 1212. In a further embodiment, the rolled paper sleeve 1204 is replaced by a tube made of combustible material. Still further embodiments have differing dimensions, differing numbers of ventilation apertures and enclose differing multiples of the water bottle and fire starter assembly 1100.

End caps 1226, 1228, which may be made of plastic, cardboard or other material secure the ends of the rolled paper sleeve 1204 and hold contents therein. In the embodiment shown, each end cap 1226, 1228 has a ridged plug 1230, 1232 that maintains a friction fit upon insertion into a respective end of the rolled paper sleeve 1204. Each end cap 1226, 1228 has an end disk 1202, 1210 of a larger diameter than the ridged plug 1230, 1232. The end disks 1202, 1210 seal the respective ends of the rolled paper sleeve 1204 and prevent the end caps 1226, 1228 from falling into or being pushed into the interior of the rolled paper sleeve 1204. In a further embodiment, each end cap 1226, 1228 has a threaded plug in place of the ridged plug 1230, 1232.

In FIG. 13, a completed canister, water bottle and fire starter assembly 1300 is shown as a survival package. Each tube section 1220, 1222, 1224 of the rolled paper sleeve 1204 has a respective water bottle and fire starter assembly 1100 contained therein. In the embodiment shown, the water bottle and fire starter assembly 1100 is a close fit within a respective tube section 1220, 1222 or 1224 of the rolled paper sleeve 1204. The available volume within the respective tube section 1220, 1222 or 1224 is utilized to package a maximum or near maximum combined volume of water and fire starter material, with very little of the available volume wasted. Such packaging makes efficient use of the available volume. The diameter of the water bottle, the diameter of the fire starter and the inner diameter of the tube section are closely matched, with spacing allowance for ready installation and removal of the water bottle and fire starter within the tube section. A close fit further minimizes jostling of the water bottles within the tube sections and thereby decreases breakage of the water bottles during transport and airdrop. In the example shown, over eighty percent of the available interior volume of the rolled paper sleeve 1204 is utilized, as occupied by the combined volume of the plurality of the water bottle and fire starter assembly 1100 installed therein. Each tube section 1220, 1222, 1224 having a water bottle and fire starter assembly 1100 is over eighty percent occupied by the water bottle and fire starter assembly 1100, by volume. In an embodiment having a single tube section, the internal volume of the tube section is over eighty percent occupied by the water bottle and fire starter assembly therein.

Multiples of the canister, water bottle and fire starter assembly 1300 can be loaded into the airdrop delivery system 100 as shown in FIG. 1, the drop unit 200 as shown in FIG. 2, the drop pallet 300 as shown in FIG. 3, or the airdrop delivery system 400 as shown in FIG. 4, or may be carried singly or in multiples as shown in FIG. 5. The canister, water bottle and fire starter assembly 1300 can be used exclusively or mixed with other canisters or payloads. In a further embodiment, multiples of the canister, water bottle and fire starter assembly 1300 are included with foodstuff, blankets, medical supplies, humanitarian aid items and/or military supplies in any of the systems as shown in FIGS. 1-5, as used in humanitarian and/or military operations. In a still further embodiment, each of one or more tube sections 1220, 1222, 1224 in a completed canister assembly includes one or more of the above-discussed materials.

With reference back to FIGS. 10-12, an assembly method is as follows. Each of three water bottles 1002 is filled with water, and a respective water bottle cap 1004 is put in place on the bottle neck 1012, sealing the water bottle 1002 and retaining the water therein. To each water bottle 1002, a collar ring 1006, a fire starter 1008 and a paper cup 1010 are installed in sequence, completing the water bottle and fire starter assembly 1000.

An end cap 1226 is installed to one end of the rolled paper sleeve 1204. One unit of the water bottle and fire starter assembly 1000 is inserted to the opposing end of the rolled paper sleeve 1204, and slides down coming to rest at the end cap 1226. A partition 1206 is inserted through the section cut 1214 in the rolled paper sleeve 1204, and the tabs 1234 are folded and secured to the rolled paper sleeve 1204. The partition 1206 secures the first water bottle and fire starter assembly 1000 in the tube section 1220, and provides a barrier separating the tube section 1220 from the neighboring tube section 1222.

A second water bottle and fire starter assembly 1000 is inserted through the opposing end of the rolled paper sleeve 1204, and slides down coming to rest at the partition 1206. A partition 1208 is inserted through the section cut 1216 in the rolled paper sleeve 1204, and the tabs 1234 are folded and secured to the rolled paper sleeve 1204. The partition 1208 secures the second water bottle and fire starter assembly 1000 in the tube section 1222, and provides a barrier separating the tube section 1222 from the neighboring tube section 1224.

A third water bottle and fire starter assembly 1000 is inserted through the opposing end of the rolled paper sleeve 1204, and slides down coming to rest at the partition 1208. An end cap 1228 is installed to the opposed end of the rolled paper sleeve 1204. The end cap 1228 secures the third water bottle and fire starter assembly 1000 in the tube section 1224. Further assembly methods are readily devised.

With reference back to FIGS. 10 and 12, a method for starting a fire is as follows. The end caps 1226, 1228 are removed from the canister, water bottle and fire starter assembly 1300, and each of the three water bottle and fire starter assembly 1000 units is removed. Each water bottle and fire starter assembly 1000 is disassembled and the water bottles 1002 with respective water bottle caps 1004 are set aside for use in providing drinking water or cooking water.

Depending on the size of the fire desired, the rolled paper sleeve 1204 is severed into sections or is used intact. A fire starter 1008 is placed in a paper cup 1010, and these are placed in or near the center of one of the tube sections 1220, 1222, 1224 of the rolled paper sleeve 1204. The tube section 1220, 1222, 1224 or the entirety of the rolled paper sleeve 1204 if used should be placed perpendicular to any wind, with ventilation apertures 1212 facing upward. Dirt, rocks or other available material can be placed at the base of the tube section 1220, 1222, 1224 or the rolled paper sleeve 1204 to prevent rolling. In the embodiment shown, the fire starter 1008 has rounded edges and rests just below the horizontal center of the rolled paper sleeve 1204. A match or a lighter is applied to the paper cup 1010, for example by applying the match or the lighter through a ventilation aperture 1212 or through an open end of the rolled paper sleeve 1204 or the tube section 1220, 1222, 1224. Once lit, the paper cup 1010 burns and the wax of the fire starter 1008 melts and spreads along the tube section 1220, 1222, 1224. Oxygen comes in through the ends of the tube section 1220, 1222, 1224 or the rolled paper sleeve 1204. Heat and hot gases produced by the fire can escape through the ventilation apertures 1212. Tests suggest that a tube section 1220, 1222, and 1224 dimensioned to a half inch wall thickness and 8½ inch length burns or produces heat for about 35-40 minutes.

Figure 14A:
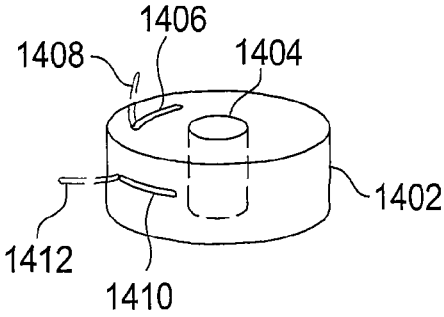
FIGS. 14*a*-14*g* are perspective views and top views of further embodiments of the fire starter of FIGS. 10 and 11.

With reference to FIGS. 14*a*-14*g*, further embodiments of the fire starter are shown. In FIG. 14*a*, the fire starter 1402 (shown in perspective view) is a toroid with a central aperture 1404 similar to the fire starter 1008 with central aperture 1018 seen in FIG. 10. The fire starter 1402 has a wick 1406 that can be pulled upwards from the surface of the fire starter 1402 to a vertical position 1408 (in dashed lines). A further wick 1410 can be pulled laterally outwards from the vertical outer surface of the fire starter 1402 to a horizontal position 1412 (in dashed lines). One or both of the wicks 1406, 1410 can then be lit in order to start a fire. Further embodiments of the fire starter 1402 have a single wick, a plurality of wicks, other types of wicks, other shapes, or other locations for one or more wicks.

Figure 14B:
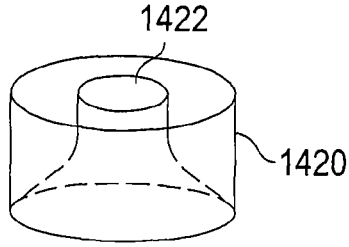

In FIG. 14*b*, the fire starter 1420 (perspective view) is a toroid with a central aperture 1422 having a funnel-like shape (shown in dashed lines). A portion of the central aperture 1422 is cylindrical, and a further portion of the central aperture 1422 is conical. The fire starter 1420 has a greater volume or mass of wax for starting a fire than does a fire starter having solely the portion of wax surrounding the cylindrical portion of the central aperture 1422 and lacking the further volume of wax surrounding the conical portion of the central aperture 1422. Further embodiments of the fire starter 1420 have other shapes for the central aperture 1422 and differing volumes or masses of wax. The shapes for the central aperture can be devised to fit various water bottles, as will be shown with reference to FIGS. 15*a*-15*h*.

Figure 14C:
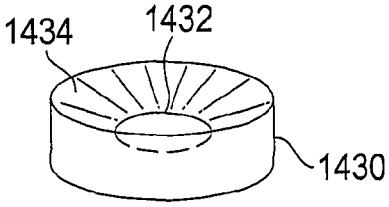

In FIG. 14*c* the fire starter 1430 (perspective view) is a toroid with a central aperture 1432 having a conical or rounded conical shape. The shape of the central aperture 1432 provides a complementary fit to a bottle with a conical or rounded top or bottom.

Figure 14D:
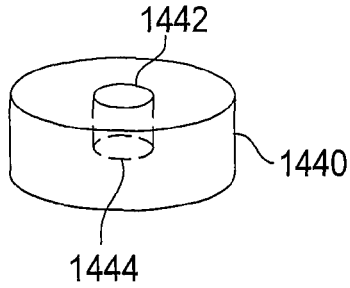

In FIG. 14*d*, the fire starter 1440 (perspective view) is a disk with a central depression 1442. The floor 1444 (shown in dashed lines) of the central depression 1442 is at a depth within the fire starter 1440. Similarly to the fire starter 1008, which is a toroid having a central aperture 1018, the fire starter 1440 fits over a water bottle cap and thus over the neck of a water bottle. As a result of having the extra thickness of wax between the depth of the floor 1444 and a back surface (not shown) of the fire starter 1440, the fire starter 1440 has a greater volume or mass of wax than does a fire starter 1008 when other related dimensions (e.g. diameter of the bottle, height of the bottle cap) are similar.

Figure 14E:
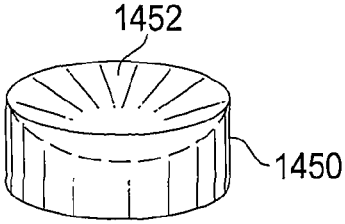

In FIG. 14*e*, the fire starter 1450 (perspective view) is a disk with a central depression 1452 (shown in shading lines and dashed line for inner contour). The central depression 1452 fits a bottle with a rounded bottom. Lacking a central aperture, the fire starter 1450 has a greater volume or mass of wax than does a toroid of otherwise similar dimensions. Further embodiments of the fire starter 1450 have various shapes providing complementary fit to other types of bottle bottoms.

Figure 14F:
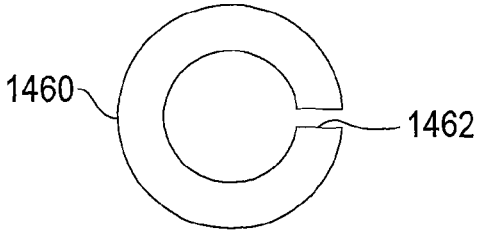

In FIG. 14*f*, the fire starter 1460 (top view) is a "C"-shaped block of wax having a gap 1462 between the open ends of the letter "C". Similarly to the fire starter 1008, the fire starter 1460 fits over a water bottle cap and thus over the neck of a water bottle. The gap 1462 facilitates grasping and breaking the fire starter 1460 into two or more smaller pieces, each of which may be used to start a fire.

Figure 14G:
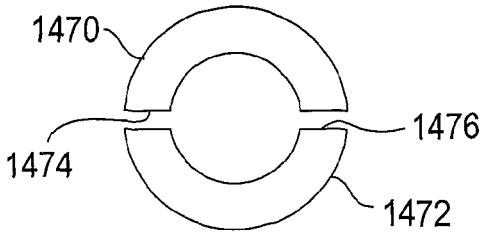

In FIG. 14*g*, the two-piece fire starter 1470, 1472 (top view) can be separated into two halves. Similarly to the fire starter 1008, the fire starter 1470, 1472 fits over a water bottle cap and thus over the neck of a water bottle. One or both of the gaps 1474, 1476 between the two halves of the fire starter 1470, 1472 can be closed by bonding the two halves together at such a gap, for example by melting the wax and sticking the two halves together. Further embodiments have more than two pieces, pieces of unequal shapes, a single piece scored for ready breakage and separation into two or more pieces, and so on.

With reference to FIGS. 15*a*-15*h*, further embodiments of an assembled water bottle and fire starter assembly are shown. In keeping with the goal of maximizing efficient use of available volume within a tube section, the embodiments show various trade-offs in volume of water versus volume of wax in the fire starter, and show complementary shapes of water bottles and fire starters that fit well together.

Figure 15A:
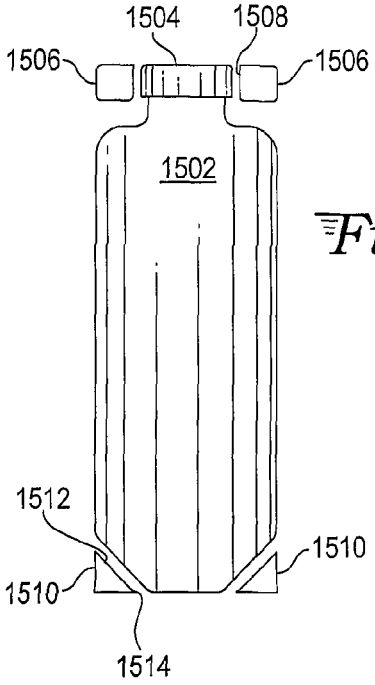
FIGS. 15*a*-15*h* are partial cross-section side views and perspective views of further embodiments of the assembled water bottle and fire starter assembly of FIG. 11.

In FIG. 15*a*, a water bottle 1502 (shown solid with shading lines) with a water bottle cap 1504 is fitted with two fire starters. A first fire starter 1506 (shown in cross-section view) has a central aperture 1508, and is a toroid that fits over the water bottle cap 1504. The first fire starter 1506 is similar to or may be the fire starter 1008 shown in FIG. 10 or the fire starter 1402 shown in FIG. 14*a*. A second fire starter 1510 (shown in cross-section view) is a toroid having a central aperture 1514 with a conical wall 1512. The fire starter 1510 is similar to or may be the fire starter 1430 shown in FIG. 14*b* and fits a corresponding and complementary truncated conical bottom of the water bottle 1502.

Figure 15B:
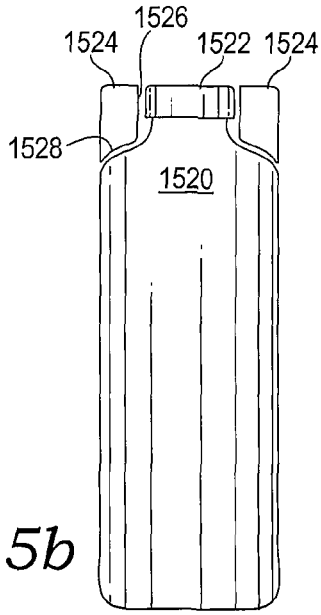

In FIG. 15*b*, a water bottle 1520 (solid view) with a water bottle cap 1522 is fitted with a fire starter 1524 (cross-section view). The fire starter 1524 has a central aperture 1526 with an upper cylindrical region and a lower conical region 1528, and is similar to or may be the fire starter 1420 shown in FIG. 14*b*. The lower conical region 1528 fits an upper sloping-sided or conical portion of the water bottle 1520.

Figure 15C:
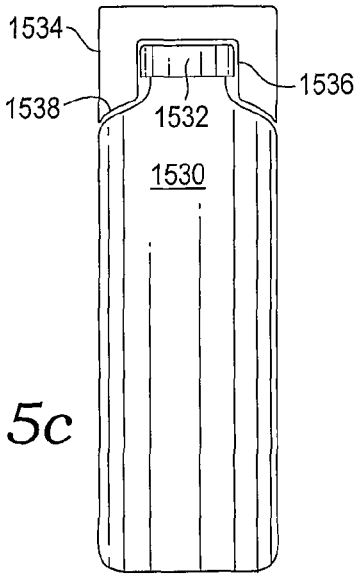

In FIG. 15*c*, a water bottle 1530 (solid view) with a water bottle cap 1532 is fitted with a fire starter 1534 (cross-section view). The fire starter 1534 has a central depression 1536. A cylindrical portion of the central depression 1536 fits over the water bottle cap, and a conical region 1538 of the fire starter 1534 fits an upper sloping-sided or conical portion of the water bottle 1530.

Figure 15D:
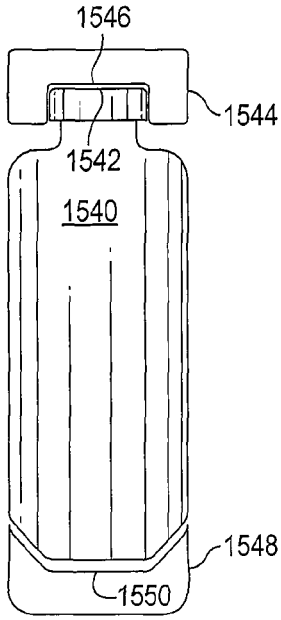

In FIG. 15*d*, a water bottle 1540 (solid view) with a water bottle cap 1542 is fitted with two fire starters 1544, 1548. A first fire starter 1544 (cross-section view) has a central depression 1546 that fits over the water bottle cap 1542, and is similar to or may be the fire starter 1440 shown in FIG. 14*d*. A second fire starter 1548 (cross-section view) has a central depression 1550 that fits a truncated conical or rounded bottom of the water bottle 1540.

Figure 15E:
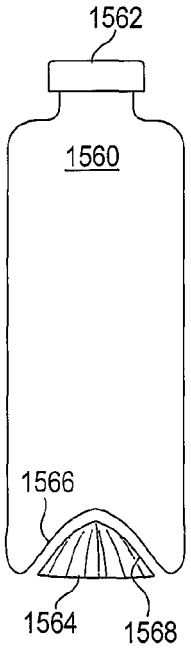

In FIG. 15*e*, a water bottle 1560 (shown in cross-section view) with a water bottle cap 1562 is fitted with a fire starter 1564 (shown solid with shading lines). The fire starter 1564 has a domed surface 1568 that fits into a rounded depression 1566 in the base of the water bottle 1560. Further embodiments of the fire starter 1564 have other shapes that fit complementary or corresponding depressions in water bottles.

Figure 15F:
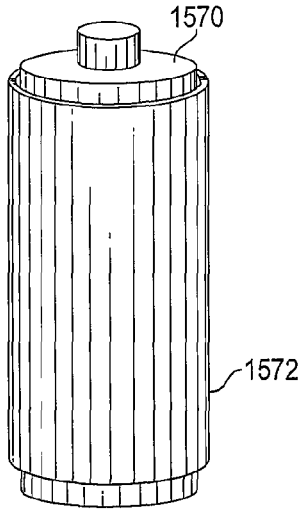

In FIG. 15*f*, a water bottle 1570 (shown in perspective solid view) is fitted with a cylindrical fire starter 1572 (perspective solid view). The cylindrical fire starter 1572 is a sleeve that fits over the body of the water bottle 1570.

Figure 15G:
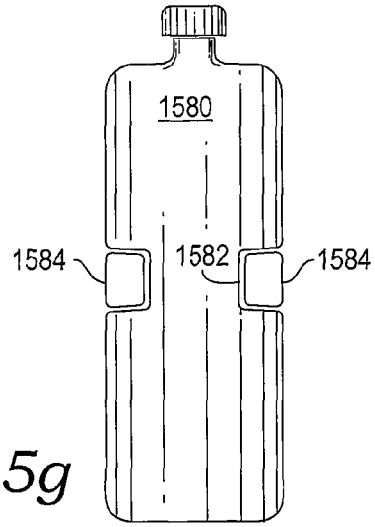
Figure 15H:
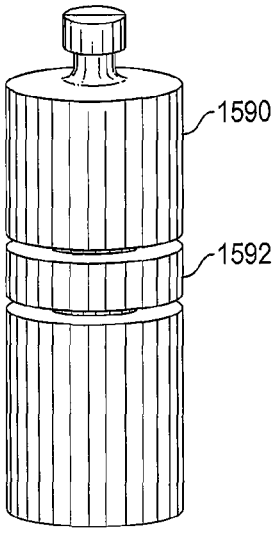

In FIGS. 15*g* and 15*h*, a toroidal or semi-toroidal fire starter 1584 (cross-section view), 1592 (solid view) encircles a pinched-waist section 1582 of the water bottle 1580 (solid view), 1590 (solid view). The fire starter 1584, 1592 is similar to or may be the fire starter 1008 shown in FIG. 10, the fire starter 1460 in FIG. 14*f* or the fire starter 1470, 1472 in FIG. 14*g*. Suitable methods for manufacturing this embodiment include molding a wax toroid around the pinched-waist section of the water bottle 1580, 1590, heating portions of the wax at one or both gaps 1474, 1476 of the two-piece fire starter 1470, 1472 and pressing the two halves together at the pinched-waist section, or dimensioning the gap 1462 in the "C"-shaped fire starter 1460 so that the pinched-waste section of the water bottle 1580 can be slipped through the gap 1462.

Further embodiments combine one or more features from the shown embodiments. One or more wicks can be added to one or more of the fire starters. Two or more fire starters can be packaged with each water bottle. A fire starter can be packaged with one of the water bottles in a tube section of a completed canister and omitted in the other tube sections. Fire starting materials other than wax can be used in the fire starters.

Various assumptions can be used to guide dimensioning of the airdrop delivery system and subassemblies, although further assumptions and further dimensions can be applied. A 10 by 10 array of compartments of a load matrix core has 100 compartments. Each compartment holds one canister with three water bottles of 16.9 fluid ounces each, for a total of 300 such water bottles or 39.6 gallons per drop module. A 96 inch by 88 inch drop skid holds six drop modules for a total of 237 gallons of water. At one gallon per soldier or relief worker per day, a 12 person team is sustained by one drop platform with water rations for 19.8 days, or 18 days with 10% loss on impact. Total weight of each canister, including water, is 4.7 pounds. Dividing 100 canisters, including water, among 12 people in a team results in each person carrying 42 pounds.

Fire and fuel can be calculated using the above assumptions. 100 pressed wood canister units results in 200 halves. Each half unit burns for about three quarters of an hour. The total number of canisters thus provides 150 burn hours, or 37.5 burn hours with four halves per fire. This is equal to a four hour burn for each of 9.375 days.

Dimensions of a further embodiment of the airdrop delivery system are as follows. An airdrop delivery system of 48 inches in length, 25.5 inches in width and 60 inches in height, including the energy absorbing base, holds 252 water bottles at a total weight of 300 pounds. The load matrix is made of 0.30 inch thick waxed cardboard.

In versions made of cardboard, cardboard-related materials, wood and/or wood products, the entire contents of the airdrop delivery system except for the plastic water bottles will burn when ignited. The resultant fire provides soldiers, relief workers or survivors with heat and cooking capabilities. The unit contains plastic water bottles on the inside, which soldiers or other personnel use for drinking water while stationed at a post where neither fire nor water would otherwise be available. The airdrop delivery system combines the two survival requirements of fire building materials and water into one package, relieving the need for separate airdrops of firewood. The airdrop delivery system provides a solution to the problem of water delivery that can survive a ground impact, provides packaging that serves as fuel for fires, and provides packaging that supports all delivery modes. The airdrop delivery system enables transfer and carry of water and fire making supplies by each soldier or other personnel. In disaster, humanitarian or military situations, the airdrop delivery system described herein can be safely dropped by a helicopter from a height of 20 feet to 30 feet without a parachute and with impact survival.

What is claimed is:

1. A survival package comprising:

a rolled paper tube having a plurality of ventilation apertures; and one or more water bottle and fire starter assemblies contained within the tube, each including a water bottle having a water bottle cap, a paraffin toroid dimensioned to fit over the water bottle cap, and a paper cup dimensioned to snugly fit over the paraffin toroid;

wherein a fire can be started by placing the paraffin toroid, in the paper cup, within the rolled paper tube and lighting the paper cup.

2. The survival package of claim 1 further comprising a cardboard collar dimensioned to fit over the neck of the water bottle.

3. The survival package of claim 1 further comprising section cuts in the rolled paper tube, dividing the rolled paper tube into tube sections.

4. The survival package of claim 3 wherein each of the tube sections has one or more of the ventilation apertures.

5. The survival package of claim 3 further comprising paper or cardboard partitions inserted into the section cuts.

6. The survival package of claim 1 further comprising an airdrop packaging having a plurality of compartments atop an energy absorbing base, wherein a plurality of the rolled paper tube containing the one or more water bottle and fire starter assemblies is disposed within the compartments of the airdrop packaging.

* * * * *